United States Patent [19]

Malouf, Jr.

[11] 4,286,337

[45] Sep. 1, 1981

[54] SHAPE RETAINING COLLAR DEVICES AND ARTICLES OF WEARING APPAREL USING SAME

[76] Inventor: Edmond A. Malouf, Jr., 13440 Tiara St., Van Nuys, Calif. 91401

[21] Appl. No.: 78,553

[22] Filed: Sep. 24, 1979

[51] Int. Cl.[3] ..... A41B 1/14

[52] U.S. Cl. ..... 2/116; 2/132; 2/256

[58] Field of Search ..... 2/116, 132, 255, 256, 2/258; 24/49 KC, 61

[56] References Cited

U.S. PATENT DOCUMENTS

| | | | |
|---|---|---|---|
| 2,110,525 | 3/1938 | Kass | 2/132 |
| 2,487,284 | 11/1949 | Thomas | 2/132 |
| 2,964,756 | 12/1960 | Liebowitz | 2/132 |
| 3,115,642 | 12/1963 | Haring | 2/256 |

*Primary Examiner*—H. Hampton Hunter

*Attorney, Agent, or Firm*—Romney, Golant, Disner & Ashen

[57] ABSTRACT

A shape retaining collar device for use with garments of wearing apparel as for example, a shirt having a torso covering segment. The shape retaining collar device in the garment construction includes a first fabric portion which is attachable to the torso covering segment and which is generally non-exposed to a viewer. This first fabric portion may be in the form of a band for attachment to the garment and extending outwardly from the first fabric portion is a second fabric portion in the form of a collar which essentially forms a neckline for the garment. Moreover, the second fabric portion terminates in a pair of edges which are forwardly presented to a viewer of the collar. A channel is formed within the second fabric portion for receiving a collar stay and a channel is also formed in the first fabric portion for receiving an integrally formed tab on this collar stay. The tab is located at an acute angle with respect to the collar stay and is relatively rigid to retain the shape of the collar at least at an acute angle with respect to the first fabric portion.

15 Claims, 7 Drawing Figures

SHAPE RETAINING COLLAR DEVICES AND ARTICLES OF WEARING APPAREL USING SAME

BACKGROUND OF THE INVENTION

1. Field of the Invention

This invention relates in general to certain new and useful improvements in shape retaining collar devices and garments of wearing apparel utilizing such collar devices and more particularly, shape retaining collar devices which enable a collar to maintain a neat and somewhat rigid position but nevertheless a natural looking position with respect to the remaining portion of the garment.

2. Brief Description of the Prior Art

The use of collar stays with shirts, and particularly decorative and so-called dress shirts, has been known and commercially available for a long period of time. In many shirt constructions, for example, the collar stays are permanently imbedded in the collar and in other shirt constructions, a channel is formed within the collar for receiving the collar stay. These shirt collars typically have forwardly presented edges extending from a neckline and which edges terminated at lower collar points or tips.

These prior art constructions utilized a plastic collar stay which had somewhat of a tapered lower end. The collar stay was inserted in the shirt collars to extend from the neckline or in proximity to the neckline near each of the forwardly presented edges thereof toward the tips of the collar. Further, the prior art collar stays extended upwardly from there at an angle of about 45° with respect to the forwardly presented edges of the collar. Moreover, the collar stays were preferably of a straight segment and did not include any angularly disposed portions. In addition, the collar stays were fairly rigid and non-bendable as such.

These collar stays and the garments utilizing the same were primarily designed for garments where the collar was normally retained in a fairly rigid position around the shirt by means of a collar button and button hole. Thus, the garment had the torso covering segment extended upwardly toward the collar and was provided with a button and button hole. In this way, the collar did more or less retain its shape so long as the shirt was buttoned. The collar stays were provided to keep the collars fairly straight or unbended.

Heretofore, there has been no effective means for enabling a shirt with a collar and particularly of a somewhat flexible construction to retain a particular shape with respect to the torso covering section, and even more so with V-neck shirts on the torso covering portion.

OBJECTS OF THE INVENTION

It is, therefore, a primary object of the present invention to provide a shape retaining collar device for use with garments of wearing apparel and which collar device includes a first fabric portion attachable to a torso covering segment of the garment and a second fabric portion which extends outwardly therefrom at an acute angle with respect to the first fabric portion to represent a collar along with a shape retaining collar stay on the second fabric portion and a tab extending through a portion of the first fabric portion.

It is another object of the present invention to provide a shape retaining collar device of the type stated which can be effectively utilized with a wide variety of shirts and other garment constructions.

It is an additional object of the present invention to provide a shape retaining collar device of the type stated which utilizes relatively rigid but yet bendable collar stays and where a portion of the stay in the form of a tab is bent at an acute angle so as to cause a portion of the collar device to retain an acute angle with respect to at least the neck portion of the garment of wearing apparel.

It is also an object of the present invention to provide a shirt utilizing the shape retaining collar device and which permits the collar thereof to always assume a relatively rigid but yet naturally looking and neat appearance.

It is a salient object of the present invention to provide a method of making a shirt with a shape retaining collar by attaching a first fabric portion of a collar on a shirt body and permitting a second portion of the fabric to extend outwardly therefrom and locating a collar stay with an acutely bent tab through the first fabric portion and the stay itself through the second fabric portion so as to maintain a relatively rigid but yet natural looking collar appearance with respect to the shirt.

With the above and other objects in view, my invention resides in the novel features of form, construction, arrangement and combination of parts presently described and pointed out in the claims.

A BRIEF SUMMARY OF THE DISCLOSURE

A shape retaining collar device for use with garments of wearing apparel and a shirt using such collar device. The shape retaining collar device could be used essentially with any garment of wearing apparel which has a torso covering segment, as for example, shirts, jackets, sweaters and the like.

This first fabric portion may be in the form of a band which is located on the interior portion of the torso covering segment in proximity to the upper end thereof which may constitute the neckline or which may be in proximity to the neckline of the garment. A second fabric portion, in the form of a collar, extends outwardly from the first fabric portion. This second fabric portion has as least one edge which is forwardly presented to a veiwer of the collar and preferably, a pair of edges which are forwardly presented to a viewer. The collar has a tip at the edge portion which is spaced from the neckline at this forwardly presented edge.

A retaining means is formed with the collar and usually with the first fabric portion as well to retain a collar stay at least with respect to the shirt and collar. A collar stay is located at or at least in proximity to the forwardly presented edge of the second fabric portion of the collar and preferably at both of the forwardly presented edges of the collar. Further, the collar stay will extend from at least the neckline to the tip portions of the collars, or at least for a major portion of the distance from the neckline to the tip portion. The collar stay is preferably parallel to the edge of the collar.

A tab is formed with the collar stay and is bent at an acute angle with respect to the collar stay. This tab extends along the first fabric portion at an acute angle with respect to the stay in order to enable the second fabric portion to establish an acute angle with respect to the first fabric portion. In this way, the collar which extends outwardly from the shirt will maintain a fairly rigid shape with respect to at least the first fabric portion which is located on the interior of the shirt and appears to be part of the torso covering segment to the viewer. Further, by virtue of the fact that the stay is at least fairly rigid, it is capable of holding the collar up so that it always presents a neat appearance.

The stay is preferably integrally formed with respect to the tab. Moreover, the stay and the tab are formed of a plastic or metal strip, and preferably a bendable metal strip which is provided with an outer covering, the latter being formed of a plastic or a fabric material. The metal or interior strip should be at least bendable so that the stay can be bent at the desired angle with respect to the tab and also to retain this position.

This invention possesses many other advantages and has other purposes which may be made more clearly apparent from a consideration of the forms in which it may be embodied. These forms are shown in the drawings forming and accompanying part of the present specification. They will now be described in detail for the purposes of illustrating the general principals of the invention, but it is to be understood that such detailed descriptions are not to be taken in a limiting sense.

BRIEF DESCRIPTION OF THE DRAWINGS

Figure 1:
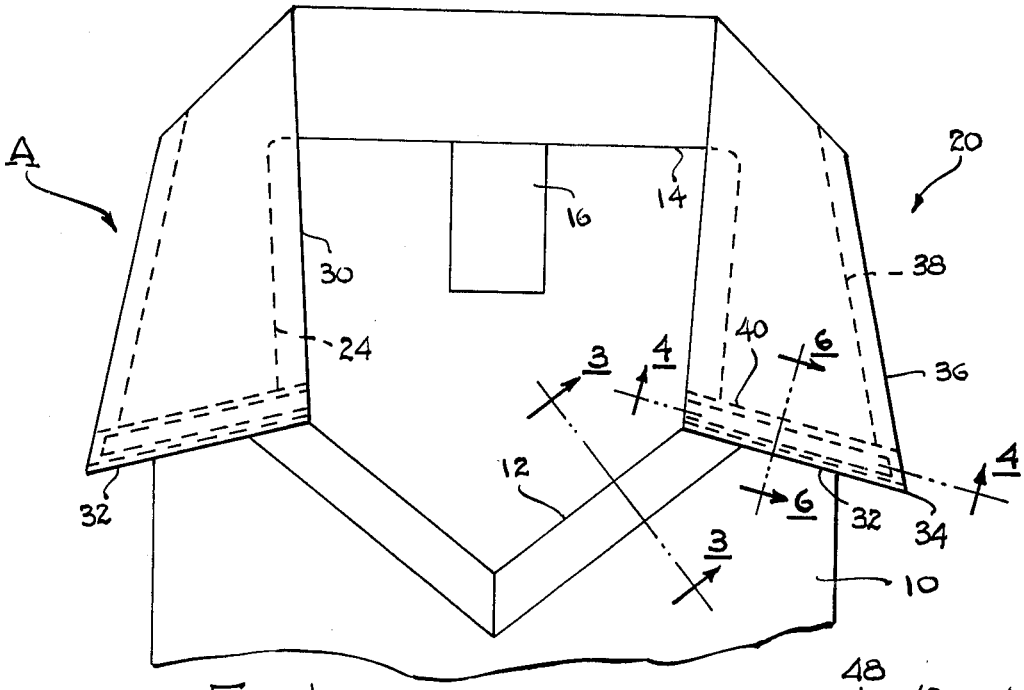
Figure 6:
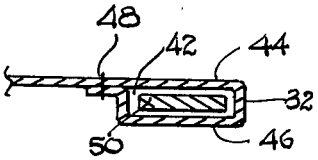
Figure 2:
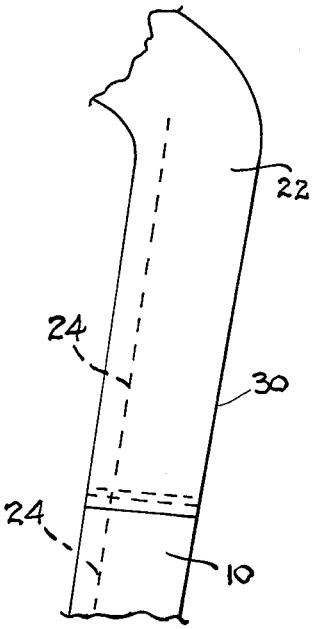
Figure 3:
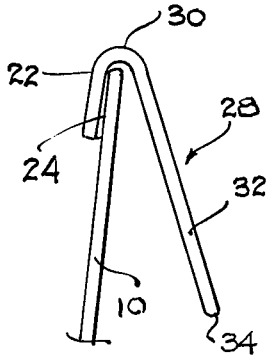
Figure 5:
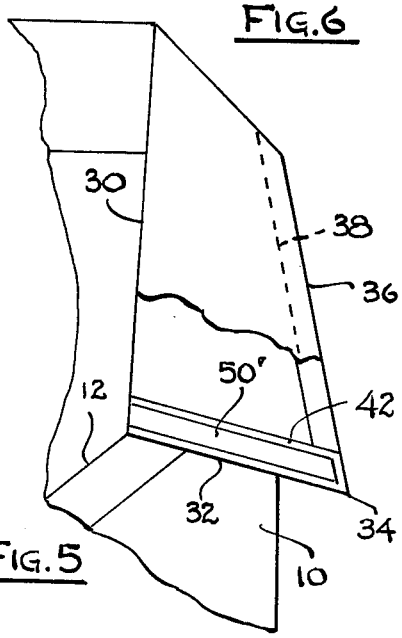
Figure 4:
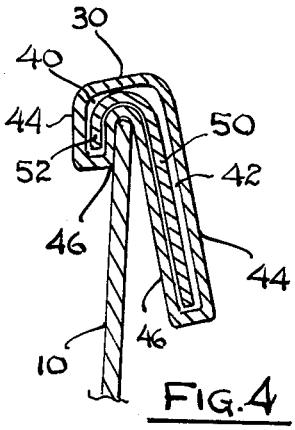
Figure 7:
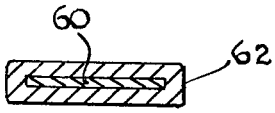

Having thus described the invention in general terms, reference will now be made to the accompanying drawings in which:

FIG. 1 is a front elevational view of a shirt constructed in accordance with and embodying the collar device of the present invention;

FIG. 2 is a rear elevational view of a portion of the shirt in a region where the shape retaining collar device is adjoined to the shirt and showing the same lines thereof;

FIG. 3 is a side elevational view taken substantially along line 3—3 of FIG. 1;

FIG. 4 is a fragmentary sectional view taken along line 4—4 of FIG. 1;

FIG. 5 is a fragmentary front elevational view, partially broken away, and showing a portion of a collar stay used in a shirt constructed in accordance with the present invention;

FIG. 6 is a fragmentary sectional view taken along line 6—6 of FIG. 1 in an essentially perpendicular line of view with respect to FIG. 4; and FIG. 7 is a cross-sectional view of one of the collar stays used in the shape retaining collar device and the shirt construction of the invention.

BRIEF DESCRIPTION OF PREFERRED EMBODIMENTS

Referring now in more detail and by reference characters to the drawings which illustrate practical embodiments of the present invention, A designates a shirt having a torso covering segment 10 and which is conventionally formed with a V-shaped so-called "plunging" neckline 12 in the front portion thereof. This type of shirt as illustrated is a typical "slip-over" shirt although it should be understood that the shape retaining collar device of the invention could be used with a wide variety of shirts, as well as other garments, as heretofore described.

The portion of the shirt forming the neckline 12 extends around to form an upper margin 14 as illustrated on a rear portion of the torso covering segment 10, as shown in FIG. 1. Suitably attached along this upper margin 14 of the torso covering segment 10 is a label 16 conventionally provided in shirts of this type.

A shape retaining collar device 20 is secured to the upper portion of the shirt 10 and is comprised of a first fabric portion 22 which is secured to the torso covering segment of the shirt through a seam line 24, which is preferably a line of stitching. Beyond the region of the V-shaped neck 12, the first fabric portion 22 is folded under the margin of the torso covering segment, which would define the neckline in absence of the collar device of the invention, and is secured thereto by means of the aforesaid line of stitching 24. This construction is more fully illustrated in FIGS. 3 and 4 of the drawings.

The first fabric portion 22 integrally merges into a second fabric portion 28 which actually functions as the collar on the shirt or other garment. The point of integral merger to the first fabric portion 22 forms a neck line 30, in the manner as illustrated in FIGS. 1 and 2. In addition, the collar device and particularly the first fabric portion 28 has two forwardly presented edges 32 which extend from the neck line 30 to tips 34 and which, in turn, define the end points of a lower or outer edge 36 of the collar or second fabric portion. The collar 28 may have a hem that is the side not visible to a viewer formed by folding material at the outer edge 36 under the collar and securing by a line of stitching 38.

A collar stay retaining means, preferably in the form of a channel 40, is formed within the first fabric portion 26. In like manner, a second channel 42 is formed within the second fabric section 28 and is effectively a continuation of the first channel.

The first fabric portion 26 and the second fabric portion 28 at least in the region of the channel 40 and the channel 42, is provided with a pair of spaced apart plys of material 44 and 46 which are used to form such channels. The pair of plys could be formed by folding the material at the forward edge 32 under and securing the material of the second ply 46 to the first ply 44 by a line of stitching 48, much in the manner as illustrated in FIG. 6 of the drawings. The outer ends of the channels would be closed by the sealing of the outer and inturned edge portions to form the hem through the line of stitching 38. However, it should be understood that any means of forming the channels could be used in the present invention.

A collar stay 50 is located within the channel 42. A reversely bent tab 52 which is integral with the stay 50 is located within the channel 40. This collar stay 50 along with the integrally formed tab 52 is hereinafter described in more detail. However, by reference to FIGS. 1 and 4, it can be observed that the collar stays 50 are located within the channels 42 in very close proximity to the forward edges of the collar. Moreover, the collar stays 50 extend substantially from the neckline 30 to the tips 34.

In this respect, it should be understood that the collar stays 50 and in addition the tabs 52 have been shown as being located at or adjacent to the front edges 32. However, it should be understood that they could also be located in close proximity to the edges. It is also important that the stay and the tabs extend in a generally parallel planes with respect to the edges 32. The stays could be off-set slightly with respect to a parallel arrangement with the edges 32 although they should not deviate from a true parallel arrangement with the edges 32 by any substantial amount. The stays and their integrally formed associated tabs 46 are inserted in the channels as indicated above. However, it should be understood that they could be physically attached to the collar as for example, the second fabric section as well as the first fabric section by means of adhesives or the like.

One of the preferred forms of the collar stays used in the shape retaining collar device of the invention is more fully illustrated in cross-sectional view in FIG. 7 of the drawings. These collar stays 50 (and for that matter the tabs 52) have the same construction and are comprised of an inner strip 60 preferably formed of a bendable material as for example, a thin gauge metal, such as aluminum or the like. However, any bendable metal could by employed including, for example, aluminum, iron or other metals. Moreover, bendable plastics which are capable of having some resiliancy when bent and yet which are capable of retaining their shape could be employed. These inner strips 60 are covered by a suitable cover material 62, preferably formed of a fabric or for that matter, a suitable plastic. In like manner, the covering material 62 would also be bendable and would also retain its shape after being bent to the desired shape. As indicated previously, it is necessary to have the tab 52 located at an acute angle with respect to the stay 50 and the inner strip enables this structure to be achieved.

Another one of the unique advantages achieved by the shape retaining collar device as used with the garment is that it prevents the seam, as for example, the inner seam 24 from being viewable. In many cases, heretofore, the collar would tend to pull the V-neck portion 12 over such that at least a portion of the seam 24 would be apparent to the viewer. By virtue of the fact that the stay 50 and the tab 52 form a fairly rigid structure, the V-neck 12 always retains its shape and the collar always retains its shape on the garment. The same advantage is achieved whether or not the shape retaining collar is used in a garment which has a V-neck or other form of neckline.

The shape retaining collar device of the invention is also highly effective in that it enables the user to position the collar of the garment at a desired angle with respect to the garment so as to create the desired appearance. Moreover, inasmuch as the stay and the tab have a substantial degree of rigidity, the collar will remain in the position selected by the user, e.g., the position in which the collar has been disposed. Further, the design of the collar device is such that the stay along with the integrally formed tab, permits the collar to maintain a rather neat appearance and prevent wrinkling of the material thereof. The collar also has a more uniform appearance by virtue of the construction of the present invention.

Thus, there has been illustrated and described an unique and novel shape retaining collar device which utilizes collar stays along forward edges of the collar and reversely bent acutely angled tabs on an inner portion of the collar, as well as unique and novel articles of wearing apparel using such collar. Thus, the invention devices, fulfills all of the objects and advantages sought therefore. It should be understood that many changes, modifications, variations and other uses and applications will become apparent to those skilled in the art after considering this specification and the accompanying drawings. Therefore, any and all such changes, modifications, variations and other uses and applications which do not depart from the spirit and scope of the invention or deemed to be covered by the invention which is limited only be the following claims.

Having thus described my invention, what I desire to claim and secure by letters patent is:

1. A shape retaining collar device for use with garments of wearing apparel including a torso covering segment, said shape retaining collar device comprising:

(a) a first fabric portion attachable to said torso covering segment and which first fabric portion is generally non-exposable to a viewer, (b) a second fabric portion extending from said first fabric portion in the form of a collar extending around some of said first fabric portion, said second fabric portion having a pair of edges which are forwardly presented to a viewer of said collar, said first and second fabric portions being arranged so that the torso covering segment has an open neck area in the front of the garment such that a front portion of the neck of the user is exposed and which torso covering segment does not have a releasable fastening means in the neck-line region, (c) a separate collar stay located at or in proximity to the forwardly presented edges of said second fabric portion and extending for at least the major portion of the dimension of said edges of said second fabric portion, said collar stays also being located so that they are parallel to the forwardly presented edges of the second fabric portion, and (d) a tab extending from each said stay and extending along said first fabric portion at an acute angle with respect to said stays to enable said second fabric portion to establish an acute angle with said first fabric portion, said tabs also being parallel in at least one plane to the collar stays from which they extend.

2. The shape retaining collar device of claim 1 further characterized in that said first fabric portion and second fabric portion define a garment neckline at a point of joinder.

3. The shape retaining collar device of claim 2 further characterized in that said pair of edges extend from said neckline to terminal tip portions, and said stays extend from said neckline to said tip portions.

4. The shape retaining collar device of claim 1 further characterized in that said first fabric portion has an interiorly formed channel at each of said edges which receives said tabs and said second fabric portion has an interiorly formed channel at each of said edges which receive said stays.

5. The shape retaining collar device of claim 1 further characterized in that said tabs are integral with said stays.

6. The shape retaining collar device of claim 5 further characterized in that each said stay and tab are formed of a bendable plastic or metal strip encapsulated in a fabric covering.

7. A shirt construction comprising:

(a) a shirt body portion, (b) a shirt collar on said body portion and forming a neckline to at least partially encircle the neck of a wearer, said collar having a pair of tips spaced apart from the neckline and a pair of edges with each extending from the neckline to the associated tip, said shirt body portion and shirt collar being arranged so that the shirt body portion and collar have an open neck area in the front of the shirt such that a front portion of the neck of a user is exposed and which shirt body portion does not have a releasable fastening means in the neckline region, (c) retaining means to retain a collar stay with respect to said shirt collar at each of the pair of edges, and (d) a separate collar stay retained by each said retaining means and extending along each said edge in close proximity to each said edge from said neckline, each said collar stay having a tab located at an acute angle with respect to said stay and which tab extends inwardly of said shirt collar at said neckline, each of said collar stays also being located so that they are parallel to the edges which are forwardly presented edges.

8. The shirt construction of claim 7 further characterized in that each said stay extends from said neckline to said associated tip.

9. The shirt construction of claim 8 further characterized in that each said stay is generally equidistantly spaced from the associated edge along the distance from said neckline to said tip.

10. The shirt construction of claim 7 further characterized in that each said retaining means is an elongate channel in said collar, and each said collar stay extends within the channel with which it is associated.

11. The shirt construction of claim 7 further characterized in that said shirt construction comprises said pair of tips with each being on opposite sides of said neckline, each said retaining means being located on each of the opposite sides and a separate collar stay held by each said retaining means, and each collar stay having a tab located at an acute angle extending inwardly of said shirt collar at said neckline.

12. The shirt construction of claim 7 further characterized in that each said stay and each said tab associated therewith are integral with each other and bent relative to one another.

13. The shirt construction of claim 12 further characterized in that said stays and tabs are comprised of a bendable plastic or metal strip encapsulated in a fabric covering.

14. A shirt construction having a shape retaining collar comprising:

(a) a shirt body portion, (b) a shirt collar on said body portion and forming a neckline to at least partially encircle the neck of a wearer, said shirt collar being comprised of:

(1) a first collar fabric portion attached to said body portion and which first fabric portion is generally non-exposable to a viewer, (2) a second fabric portion extending from said first fabric portion in the form of a collar exterior extending around the first fabric portion, said second fabric portion having a pair of edges which are forwardly presented to a viewer of said collar and which edges terminate in lower tips, said first and second fabric portions being arranged so that the body portion has an open neck area in the front of the garment such that a front portion of the neck of a user is exposed and which body portion does not have a releasable fastening means in the neckline region;

(c) means forming collar stay channels at each of said edges extending for the length of said edges;

(d) a separate collar stay located in the channels at the forwardly presented edges of said second fabric portion and extending for at least the major portion of the dimension of said edges of said second fabric portion, said collar stays also being located so that they are parallel to the forwardly presented edges of the second fabric portion; and (e) a tab extending from and being integral with each said stay and extending along said first fabric portion at an acute angle with respect to said stays to enable said second fabric portion to establish an acute angle with said first fabric portion.

15. The shape retaining collar device of claim 14 further characterized in that each said stay and tab are formed of a bendable plastic or metal strip encapsulated in a fabric covering.

* * * * *